US011486057B2

(12) United States Patent
Uchida et al.

(10) Patent No.: US 11,486,057 B2
(45) Date of Patent: Nov. 1, 2022

(54) ELECTROSPINNING APPARATUS

(71) Applicant: Kabushiki Kaisha Toshiba, Minato-ku (JP)

(72) Inventors: Kenya Uchida, Yokohama (JP); Yuma Kikuchi, Kashiwazaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 204 days.

(21) Appl. No.: 16/829,448

(22) Filed: Mar. 25, 2020

(65) Prior Publication Data

US 2020/0224334 A1 Jul. 16, 2020

Related U.S. Application Data

(63) Continuation of application No. PCT/JP2018/003639, filed on Feb. 2, 2018.

(30) Foreign Application Priority Data

Sep. 25, 2017 (JP) ..... JP2017-183923

(51) Int. Cl.
*D01D 5/04* (2006.01)
*D01D 5/00* (2006.01)
*D04H 1/728* (2012.01)

(52) U.S. Cl.
CPC ..... *D01D 5/04* (2013.01); *D01D 5/0007* (2013.01); *D04H 1/728* (2013.01)

(58) Field of Classification Search
None
See application file for complete search history.

(56) References Cited

U.S. PATENT DOCUMENTS 4,351,492 A * 9/1982 Aoyama ..... B65H 54/88 226/193
5,558,825 A * 9/1996 Ueda ..... D02J 1/222 264/103
8,522,520 B2 * 9/2013 Smit ..... D01D 5/0076 57/200

(Continued)

FOREIGN PATENT DOCUMENTS

JP 2000-296529 A 10/2000
JP 2001-001252 A 1/2001

(Continued)

OTHER PUBLICATIONS

Japanese Office Action dated Jun. 1, 2020 in Japanese Patent Application No. 2017-183923 (with unedited computer generated English translation), 5 pages.

(Continued)

*Primary Examiner* — Niki Bakhtiari
*Assistant Examiner* — Emmanuel S Luk
(74) *Attorney, Agent, or Firm* — Maier & Maier, PLLC

(57) ABSTRACT

According to an embodiment, an electrospinning apparatus includes: a transport roll; and a head unit. The transport roll is a roll that transports a substrate. The transport has a transport surface that is in contact with the substrate when transporting the substrate. The transport surface of the transport roll has a surface roughness Ra of 1.6 or less. The head unit ejects a raw material liquid of fiber toward the substrate transported by the transport roll to form a film of the fiber on the substrate.

12 Claims, 5 Drawing Sheets

(56) References Cited

U.S. PATENT DOCUMENTS

2002/0114923 A1* 8/2002 Lilly ..... B29C 43/222 428/141
2008/0122142 A1* 5/2008 Kim ..... D01D 5/0076 264/484
2011/0247311 A1* 10/2011 Smit ..... D01D 5/0076 57/243
2011/0318442 A1* 12/2011 Weinhold ..... D01D 5/426 425/91
2012/0013692 A1* 1/2012 Innes ..... B41J 13/076 347/102
2012/0135448 A1* 5/2012 Parker ..... G01N 33/5082 435/29
2012/0207888 A1* 8/2012 King ..... A23G 4/025 426/237
2013/0052293 A1* 2/2013 Weinhold ..... B26D 7/08 425/336
2013/0273190 A1* 10/2013 Lee ..... D01D 13/00 425/174.8 E
2015/0030797 A1* 1/2015 Seo ..... C09J 7/21 264/10
2016/0047075 A1* 2/2016 Foley ..... D01D 5/0084 425/174.8 E
2016/0060790 A1* 3/2016 Park ..... D01D 13/00 425/174.8 E
2016/0190656 A1* 6/2016 La ..... D04H 1/56 429/144
2016/0229104 A1* 8/2016 Mouthuy ..... D01D 5/0023
2017/0130364 A1 5/2017 Ogura et al.
2020/0044259 A1* 2/2020 Lee ..... H01M 4/72
2020/0308740 A1* 10/2020 Bokeloh ..... D04H 1/559
2021/0207291 A1* 7/2021 Agrawal ..... D01D 5/0092

FOREIGN PATENT DOCUMENTS

JP 2007-092215 A 4/2007
JP 2007-154362 A 6/2007
JP 2007-224458 A 9/2007
JP 2012-164584 A 8/2012
JP 2016-053231 A 4/2016

OTHER PUBLICATIONS

International Search Report dated Apr. 24, 2018 in PCT/JP2018/003639 filed on Feb. 2, 2018, citing documents AO-AT therein, 2 pages.

* cited by examiner

ELECTROSPINNING APPARATUS

CROSS-REFERENCE TO RELATED APPLICATIONS

This application is a continuation of prior International Application No. PCT/JP2018/003639 filed on Feb. 2, 2018, which is based upon and claims the benefit of priority from Japanese Patent Application No. 2017-183923 filed on Sep. 25, 2017; the entire contents of all of which are incorporated herein by reference.

FIELD

An embodiment to be described here relates to an electrospinning apparatus.

BACKGROUND

In the past, an electrospinning apparatus that forms a fiber film on a substrate using an electrospinning method has been known. This existing apparatus causes a fiber raw material liquid of fiber to be ejected from a head toward a substrate that is rolled over a plurality of transport rolls and transported.

In order to improve productivity in the existing apparatus, also a technology for forming a fiber film on both surfaces of a substrate to be horizontally transported has been proposed. This proposed apparatus has a structure in which a transport roll and a surface of a substrate on which a fiber film is to be formed are in contact with each other in order to form a fiber film on both surface of the substrate.

DETAILED DESCRIPTION

According to embodiment, an electrospinning apparatus includes a transport roll; and a head unit. The transport roll is a transport roll that transports a substrate. The transport roll has a transport surface that is in contact with the substrate when transporting the substrate. The transport surface of the transport roll has a surface roughness Ra of 1.6 or less. The head unit ejects a raw material liquid of fiber toward the substrate transported by the transport roll to form a film of the fiber on the substrate.

Further, according to another embodiment, an electrospinning apparatus includes a transport roll and a head unit. The transport roll is a transport roll that transports a substrate. The transport roll has a transport surface that is in contact with the substrate when transporting the substrate. The transport surface of the transport roll includes a coating film, the coating film containing a fluorine resin.

Figure 1:
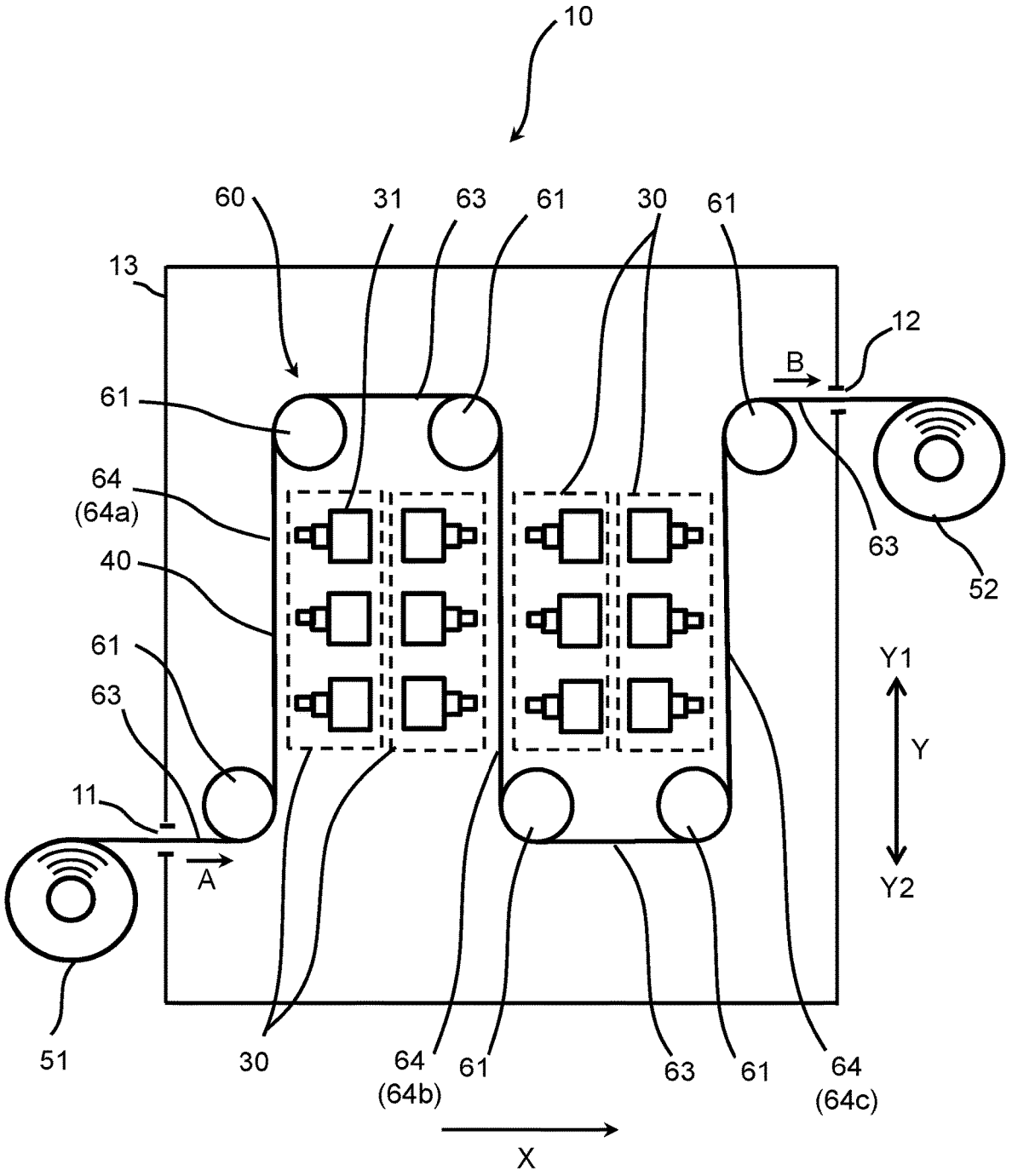
FIG. 1 is a schematic diagram showing an electrospinning apparatus according to an embodiment.

Hereinafter, with reference to the drawings, embodiments will be described. FIG. 1 shows an electrospinning apparatus according to an embodiment. An electrospinning apparatus 10 (hereinafter, referred to simply as the apparatus 10) shown in FIG. 1 forms a fiber film on both surfaces of a substrate 40 that is rolled over a plurality of transport rolls 61 and transported.

Since a fiber film is formed on both surfaces of the substrate 40, the fiber film formed on the substrate 40 is in contact with any of the plurality of transport rolls 61.

In the apparatus 10, the fiber film formed on the substrate 40 and the transport roll 61 are in contact with each other and thus at least a part of the fiber film adheres to the transport roll 61, thereby preventing the fiber film from being peeled off the substrate 40. The apparatus 10 includes the transport roll 61 having a structure that improves the releasability from the fiber film as described below, in order to prevent the fiber film from peeling.

The respective units of the apparatus 10 will be described below in detail. The apparatus 10 includes head units 30, an unwind reel 51, a take-up reel 52, a transport device 60, and the like.

As shown in FIG. 1, the head units 30 are arranged on one side of each of vertical transport paths 64*a* and 64*c* each transporting the substrate 40 in a vertical direction (Y direction in FIG. 1) and both sides of a vertical transport path 64*b*, and face the substrate 40 to be transported through the vertical transport paths 64*a* to 64*c*. Note that in the following description, the vertical transport paths 64*a* to 64*c* will be collectively referred to as the vertical transport paths 64. The head unit 30 may be disposed only on one side of the vertical transport paths 64. In this embodiment, it is favorable that the head unit 30 is disposed on both sides of the vertical transport paths 64 in order to improve the formation rate of the fiber film.

Each of the head units 30 includes at least one heads 31. In this embodiment, as shown in FIG. 1, the head unit 30 includes, for example, three heads 31.

Note that in this embodiment, the apparatus 10 includes the three vertical transport paths 64*a* to 64*c* as shown in FIG. 1. Therefore, although the apparatus 10 includes a total of four head units 30 as shown in FIG. 1, but the number of the vertical transport paths 64 and the number of the head units 30 are not limited.

A liquid feeding mechanism (not shown) that supplies a fiber raw material liquid to the head 31 is connected to the head units 30. The raw material liquid is a solution in which a raw material (e.g., polymer) of fiber is dissolved in a solvent at a predetermined concentration.

The raw material of fiber is not particularly limited, and can be appropriately changed depending on the material of the fiber film to be formed. Examples of the raw material of fiber include a polyolefin resin, a thermoplastic resin, and a thermosetting resin. The raw material of fiber can be specifically formed by blending one or two or more polymers selected from, for example, polystyrene, polycarbonate, polymethyl methacrylate, polypropylene, polyethylene, polyethylene terephthalate, polybutylene terephthalate, polyamide, polyoxymethylene, polyamideimide, polyimide, polysulfan, polyethersulfan, polyetherimide, polyether ketone, polyphenylene sulfide, modified polyphenylene ether, syndiotactic polystyrene, or a liquid crystal polymer, which is a thermoplastic resin, an urea resin, an unsaturated polyester, a phenolic resin, a melamine resin, or an epoxy resin, which is a thermosetting resin, or copolymers containing these, or the like. Note that the raw material of fiber applicable to this embodiment is not limited to the listed raw materials. The listed raw materials of fiber are only examples.

The solvent only needs to be one that is capable of dissolving the raw material of fiber. The solvent can be appropriately changed depending on the raw material of fiber to be dissolved. As the solvent, for example, a volatile organic solvent such as alcohols and aromatics, or water can be used. Specific examples of the organic solvent include isopropanol, ethylene glycol, cyclohexanone, dimethylformamide, acetone, ethyl acetate, dimethylacetamide, N-methyl-2-pyrrolidone, hexane, toluene, xylene, methyl ethyl ketone, diethyl ketone, butyl acetate, tetrahydrofuran, dioxane, and pyridine. Further, the solvent may be one kind selected from the solvents described above, or a plurality of kinds may be mixed. Note that the solvent applicable to this embodiment is not limited to the listed solvents. The listed solvents are only examples.

Further, a power source (not shown) is connected to the head unit 30. The power source applies a high voltage of, for example, 10 kv or more and 100 kv or less, to the head 31. A potential gradient is formed in the space between the head 31 and the substrate 40 when this high voltage is applied, and a charged raw material liquid is ejected from the head 31 and flies to the substrate 40.

The three heads 31 of the head unit 30 are disposed in the vertical direction (Y direction in FIG. 1) along the corresponding vertical transport path 64 by being supported by a support (not shown). The distance between the heads 31 supported by the support may be the same or differ.

Further, the heads 31 have, for example, the same structure. That is, each of the heads 31 includes an ejection unit facing the substrate 40. The ejection unit includes, for example, a plurality of nozzles that are arranged in the same direction as the width (width in the direction orthogonal to the Y direction in FIG. 1) of the substrate 40 and eject a raw material liquid. The width of the ejection unit (width in the direction in which the plurality of nozzles are arranged) is, for example, the same as the width of the substrate 40.

Further, the distance between each head 31 and the substrate 40 is, for example, the same. The distance between each head 31 and the substrate 40 is determined by, for example, ejection conditions including a voltage applied by the power source, the type of a polymer in the raw material liquid, the concentration of the raw material in the raw material liquid, and the like.

The head units 30 ejects a charged raw material liquid from the ejection unit and forms a fiber film simultaneously on, for example, both surfaces of the substrate 40 to be transported through the vertical transport paths 64. In the case of the arrangement configuration of the head units 30 in FIG. 1, the head unit 30 forms a fiber film on a first side of the substrate 40 in the vertical transport path 64*a*. Further, the head units 30 simultaneously form a fiber film on both surfaces of the substrate 40 in the vertical transport path 64*b*. Further, the head unit 30 forms a fiber film on a second side (side opposite to the first side) of the substrate 40 in the vertical transport path 64*c*. However, the order of forming the fiber film on the substrate 40 is not limited. For example, by disposing the head unit 30 on both sides of each the vertical transport paths 64, a fiber film may be simultaneously formed on both surfaces in each of the vertical transport paths 64. Further, for the vertical transport path 64*b* in FIG. 1, two head units 30 are arranged so as to face each other with the substrate 40 sandwiched therebetween. Meanwhile, by displacing the positions of the two head units 30 in the Y direction to arrange the two head units 30 so as not to face each other, a fiber film may be sequentially formed on both surface of the substrate 40. Further, by disposing the head unit 30 only on one side of each of the vertical transport paths 64, a fiber film may be formed on a first side of the substrate 40 in the first vertical transport path 64*a* and then a fiber film may be formed on the other second side of the substrate 40 in the next vertical transport path 64*b*.

With the above-mentioned configuration, first, a raw material liquid is supplied from the liquid feeding mechanism to each head 31 of the head units 30. Further, a voltage is applied to the head 31 by a power source.

Each head 31 ejects a charged raw material liquid toward one side of the substrate 40 to be transported through the vertical transport paths 64. The solvent in the raw material liquid ejected from the head 31 volatilizes in the atmosphere in the apparatus 10.

The raw material in the raw material liquid ejected from the head 31 flies and reaches one side of the substrate 40 to be transported through the vertical transport paths 64, and a fiber film is formed on both surfaces of the substrate 40 as described above.

Next, the unwind reel 51 and the take-up reel 52 will be described. The unwind reel 51 and the take-up reel 52 are rotated by a drive source (not shown). The unwind reel 51 supplies the substrate 40 to the inside of a housing 13 via an entrance 11 of the housing 13 of the apparatus 10 (see an arrow A in FIG. 1). The take-up reel 52 collects the substrate 40 on which a fiber film has been formed, which is ejected from an outlet 12 of the housing 13 (see an arrow B in FIG. 1). Note that the substrate 40 is, for example, a sheet-like electrode.

Next, the transport device 60 will be described. The transport device 60 incudes the plurality of rolls 61 for transporting the substrate 40.

The plurality of transport rolls 61 is a roll for transporting a substrate, and has a transport surface that is in contact with the substrate when transporting the substrate. In the following description, the transport surface will be referred to simply as the surface of the transport roll. The plurality of transport rolls 61 is disposed at a predetermined position in the apparatus 10 and supports the substrate 40, thereby forming a plurality of horizontal transport paths 63 that transports the substrate 40 in the horizontal direction (X direction in FIG. 1) and a plurality of vertical transport paths 64 that transports the substrate 40 in the vertical direction (Y direction in FIG. 1).

The horizontal transport paths 63 are connected to both ends of the vertical transport paths 64 in the vertical direction in order to supply the substrate 40 to the vertical transport paths 64 and to transport the substrate 40 on which a fiber film has been formed by passing through the vertical transport path 64 to the next vertical transport path 64 or the outside of the apparatus 10.

In this embodiment, as shown in FIG. 1, the transport rolls 61 form four horizontal transport paths 63. Specifically, the transport roll 61 transports the substrate 40 supplied from the entrance 11 to the first vertical transport path 64 through the first horizontal transport path 63.

Further, the transport roll 61 transports the substrate 40 that has passed through the vertical transport path 64*a* to the next vertical transport path 64*b* through the next horizontal transport path 63. Further, the transport roll 61 transports the substrate 40 that has passed through the vertical transport path 64*b* to the last vertical transport path 64*c* through the next horizontal transport path 63.

Further, the transport roll 61 transports the substrate 40 that has passed through the last vertical transport path 64 to the outlet 12 through the last horizontal transport path 63.

In this embodiment, the first horizontal transport path 63 for transporting the substrate 40 supplied from the entrance 11 is connected to the lower end (end in the Y2 direction in FIG. 1) of the vertical transport path 64. The subsequent horizontal transport paths 63 are connected alternately to the upper end (end in the Y1 direction in FIG. 1) of the two vertical transport paths 64 facing each other and the lower end of the two vertical transport paths 64 facing each other. The last horizontal transport path 63 is connected to the upper end of the vertical transport path 64.

Further, in this embodiment, as shown in FIG. 1, three vertical transport paths 64 are formed by the transport rolls 61.

Note that the number of the vertical transport paths 64, the number of the horizontal transport paths 63, and the number of the transport rolls 61 are not limited to this embodiment.

Incidentally, according to the above-mentioned configuration, the fiber film formed on the substrate 40 is in contact with any of the plurality of transport rolls 61 when the substrate 40 is transported. When the fiber film and the transport roll 61 are in contact with each other, the fiber film adheres to the transport roll 61 and at least a part of the fiber film is peeled off the substrate 40 in some cases.

Examples of a cause of the peeling off of the fiber film include the unevenness of the surface of the transport roll 61. That is, in the apparatus 10 shown in FIG. 1, the fiber film is entangled with the unevenness of the surface of the transport roll 61 and adheres thereto when the substrate 40 is transported from the vertical transport path 64 to the horizontal transport path 63. Then, when the substrate 40 and the transport roll 61 are separated from each other, the fiber film is peeled off the substrate 40 while the fiber film adheres to the surface of the transport roll 61.

Further, another cause of the peeling off of the fiber film is, for example, peeling electrification. That is, peeling electrification occurs between the transport roll 61 and the fiber film when the substrate 40 is separated from the transport roll 61 in the apparatus 10 shown in FIG. 1. Due to this peeling electrification, the transport roll 61 is, for example, negatively charged and the fiber film is, for example, positively charged, the fiber film electrostatically adheres to the transport roll 61 and is peeled off the substrate 40.

When a part of the fiber film is peeled off, the fiber on the substrate 40 is broken in some cases. The product using the substrate 40 having a portion where the fiber has been broken causes a problem. In this embodiment, as one index for evaluating the releasability, which will be described below, for suppressing the peeling off of the fiber film according to the material of the transport roll 61, the height of the fluff generated in the fiber film formed on the substrate 40 is used. Note that in the case where the height of the fluff of the fiber film is less than a certain height (e.g., less than 20 mm), the fiber film dries with time and the fluff disappears. However, in the case where the height of the fluff of the fiber film is a certain height or more (e.g., 20 mm or more), the fluff remains without disappearing even after a lapse of time.

The transport roll 61 according to the embodiment has a configuration for suppressing the peeling off of the fiber film from the substrate 40. The configuration of the transport roll 61 will be described below in detail.

The transport roll 61 has a configuration for improving the releasability in order to suppress the peeling off of the fiber film from the substrate 40. The term "releasability" used herein refers to the ease with which the fiber film is peeled off the transport roll 61. In other words, the releasability refers to the difficulty of adhering the fiber film to the transport roll 61.

Note that in the following description, the releasability for suppressing the peeling off of the fiber film from the substrate 40 due to the unevenness of the surface of the transport roll 61 will be referred to simply as the releasability A. Further, the releasability for suppressing the peeling off of the fiber film from the substrate 40 due to peeling electrification will be referred to simply as the releasability B. Further, the releasability A and the releasability B will be collectively referred to as the releasability.

The transport roll 61 according to a first embodiment will be described below. The transport roll 61 according to the first embodiment has a configuration particularly for improving the releasability A.

First, the basic configuration of the transport roll 61 will be described with reference to FIG. 2. The transport roll 61 includes a base 61*a* as shown in FIG. 2.

Figure 2:
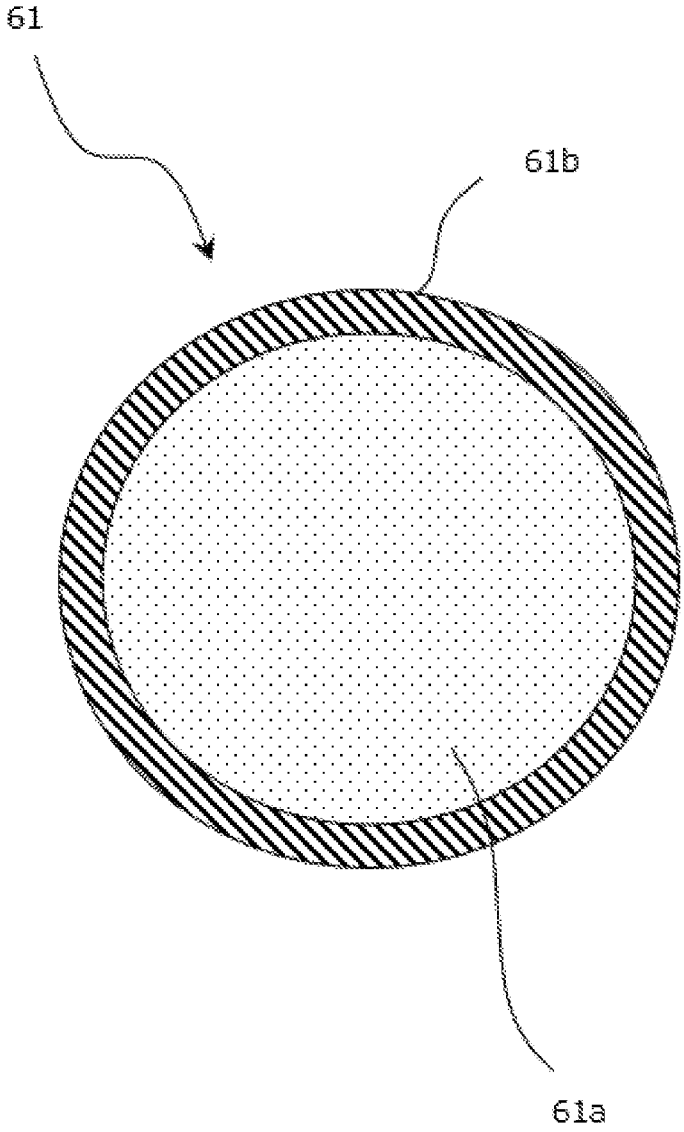
FIG. 2 is a cross-sectional view showing a transport roll used in the electrospinning apparatus according to an embodiment.

Further, the transport roll 61 may include a coating film 61*b* as shown in FIG. 2, but does not necessarily need to include the coating film 61*b*.

Examples of the material of the base 61*a* include rubber and metal. Examples of the rubber include silicone, EPT rubber, and NBR rubber. Further, examples of the metal include aluminum.

Further, the coating film 61*b* contains a fluorine resin described below, and is formed on the surface of the base 61*a*. Note that in the case where the transport roll 61 includes the coating film 61*b*, it is favorable that the base 61*a* is formed of metal as described later.

Note that in the following description, in the case of the transport roll 61 including the coating film 61*b*, the surface (transport surface) of the transport roll 61 means the surface of the coating film 61*b*. Further, in the case of the transport roll 61 that does not include the coating film 61*b*, the surface (transport surface) of the transport roll 61 means the surface of the base 61*a*.

Next, the releasability A of the transport roll 61 according to the first embodiment will be described with reference to Table 1. Table 1 shows the results of evaluating the relationship between the surface roughness Ra and the releasability A of the transport roll 61.

TABLE 1

| Evaluation roll No. | Surface roughness Ra | Evaluation Result |
|---|---|---|
| 1 | 0.4 | ○ |
| 2 | 0.8 | Δ |
| 3 | 0.8 | ○ |
| 4 | 1.6 | Δ |
| 5 | 2 to 3 | X |
| 6 | 2 to 3 | Δ |
| 7 | 9 | X |

The evaluation rolls No. 1 to 7 in Table 1 are rolls selected by a predetermined screening method. Specifically, No. 1 and No. 4 are rolls containing polytetrafluoroethylene (PTFE) as the material of the coating film 61*b*. No. 2 is a NBP rubber roll which has been subjected to low friction treatment. No. 3 is a roll containing a tetrafluoroethylene/perfluoroalkyl vinyl ether copolymer (PFA) as the material of the coating film 61*b*. No. 5 is a roll containing silicon as the material of the coating film 61*b*. No. 6 is a roll containing PFA or PTFE as the material of the coating film 61*b*. No. 7 is a roll containing a silicone/ceramic composite material as the material of the coating film 61*b*.

Further, the evaluation result in Table 1 is a result obtained by evaluating the height of the fluff generated after the substrate 40 is transported from the vertical transport path 64 shown in FIG. 1 to the horizontal transport path 63, for example. A mark "o" in the evaluation result indicates that the height of the fluff is, for example, less than 10 mm. A mark "Δ" in the evaluation result indicates that the height of the fluff is, for example, 10 mm or more and less than 20 mm. A mark "x" in the evaluation result indicates that the height of the fluff is, for example, 20 mm or more.

According to Table 1, the evaluation rolls No. 1 to 4 have an evaluation result of Δ or o, and have excellent releasability A. In other words, by setting the surface roughness Ra of the roll to 1.6 or less, it is possible to reduce the unevenness of the surface of the roll and improve the releasability A of the roll. Further, according to Table 1, also No. 6 has an evaluation result of Δ and has excellent releasability. In the case of No. 6, although the surface roughness Ra of the roll exceeds 1.6, the roll has excellent releasability because it includes the coating film 61*b* formed of a fluorine resin (PFA or PTFE) described below.

In the apparatus 10 shown in FIG. 1, on the basis of the evaluation result in Table 1, a roll having the surface roughness Ra of 1.6 or less is used as the transport roll 61 according to the first embodiment.

The apparatus 10 prevents a fiber film from peeling off the substrate 40 due to the unevenness of the transport roll 61, by the transport roll 61 having the surface roughness Ra of 1.6 or less transporting the substrate 40.

The transport roll 61 according to a second embodiment will be described below. The transport roll 61 according to the second embodiment has a configuration for, particularly, improving the releasability B.

In the case of the second embodiment, the transport roll 61 includes, as a basic configuration, the base 61*a* and the coating film 61*b* as shown in FIG. 2.

The releasability B of the transport roll 61 will be described with reference to Table 2. Table 2 shows the result obtained by evaluating the relationship between the material of the coating film 61*b* formed on the surface of the transport roll 61 and the releasability B.

TABLE 2

| Evaluation roll No. | Material of coating film | Evaluation Result |
|---|---|---|
| 11 | Silicon | X |
| 12 | Silica | X |
| 13 | Silicone/ceramic composite material | X |
| 14 | PFA | ○ |
| 15 | PTFE | Δ or ○ |
| 16 | Hard alumite | X |
| 17 | No coating film | X |

Evaluation rolls No. 11 to 16 in Table 2 are rolls including the coating film 61*b*, which is selected by a predetermined screening method. Further, an evaluation roll No. 17 is a roll that does not include the coating film 61*b*, which is selected as Comparative Example. Specifically, No. 11 is a roll that includes the coating film 61*b* containing silicon. No. 12 is a roll that includes the coating film 61*b* containing silica. No. 13 is a roll that includes the coating film 61*b* containing a silicone/ceramic composite material. No. 14 is a roll that includes the coating film 61*b* containing PFA. No. 15 is a roll that includes the coating film 61*b* containing PTFE. No. 16 is a roll that includes the coating film 61*b* containing hard alumite. No. 17 is a rubber roll formed of silicon, an EPT rubber roll, a rubber roll formed of NBR, and a metal roll formed of aluminum, which do not include the coating film 61*b*.

Further, the evaluation results in Table 2 are results obtained by evaluating the height of the fluff similarly to the case of Table 1. A "o" mark, a "Δ" mark, and a "x" mark in the evaluation results have the same meaning as in the case of Table 1.

According to Table 2, the evaluation rolls No. 14 and 15 have an evaluation result of Δ or o, and have excellent releasability B. In other words, by causing the coating film to contain a fluorine resin such as PFA and PTFE, it is possible to improve the releasability B of the roll.

Examples of the fluorine resin to be used as the material of the coating film 61*b* include a tetrafluoroethylene/hexafluoropropylene copolymer (FEP) and a tetrafluoroethylene/ethylene copolymer (ETFE) in addition to PFA and PTFE.

The base 61*a* includes a roll formed of metal such as aluminum and is connected to, for example, the ground in order to release charges accumulated in the coating film 61*b* due to peeling electrification.

The coating film 61*b* is formed on the surface of the base 61*a* and contains the above-mentioned fluorine resin. Further, the coating film 61*b* has a thickness of 10 mm or less.

Since the coating film 61*b* is a resin, i.e., an insulator, charges are accumulated in the coating film 61*b* due to peeling electrification between the coating film 61*b* and a fiber film. Further, in the case where the thickness of the coating film 61*b* exceeds 10 mm, the charges accumulated in the coating film 61*b* are less likely to be released to the base 61*a*. Therefore, the fiber film is likely to electrostatically adhere to the coating film 61*b*.

Meanwhile, in the case where the thickness of the coating film 61*b* is 10 mm or less, the charges accumulated in the coating film 61*b* are likely to be released to the base 61*a*. Therefore, it is possible to suppress peeling electrification between a fiber film and the coating film 61*b*, and improve the releasability B.

In the apparatus 10 shown in FIG. 1, on the basis of the evaluation result in Table 2, a roll that includes the coating film 61*b* containing a fluorine resin is used as the transport roll 61 according to the second embodiment.

The apparatus 10 prevents a fiber film from peeling off the substrate 40 due to peeling electrification between the fiber film and the transport roll 61, by the transport roll 61 that includes the coating film 61*b* containing a fluorine resin transporting the substrate 40.

Figure 3:
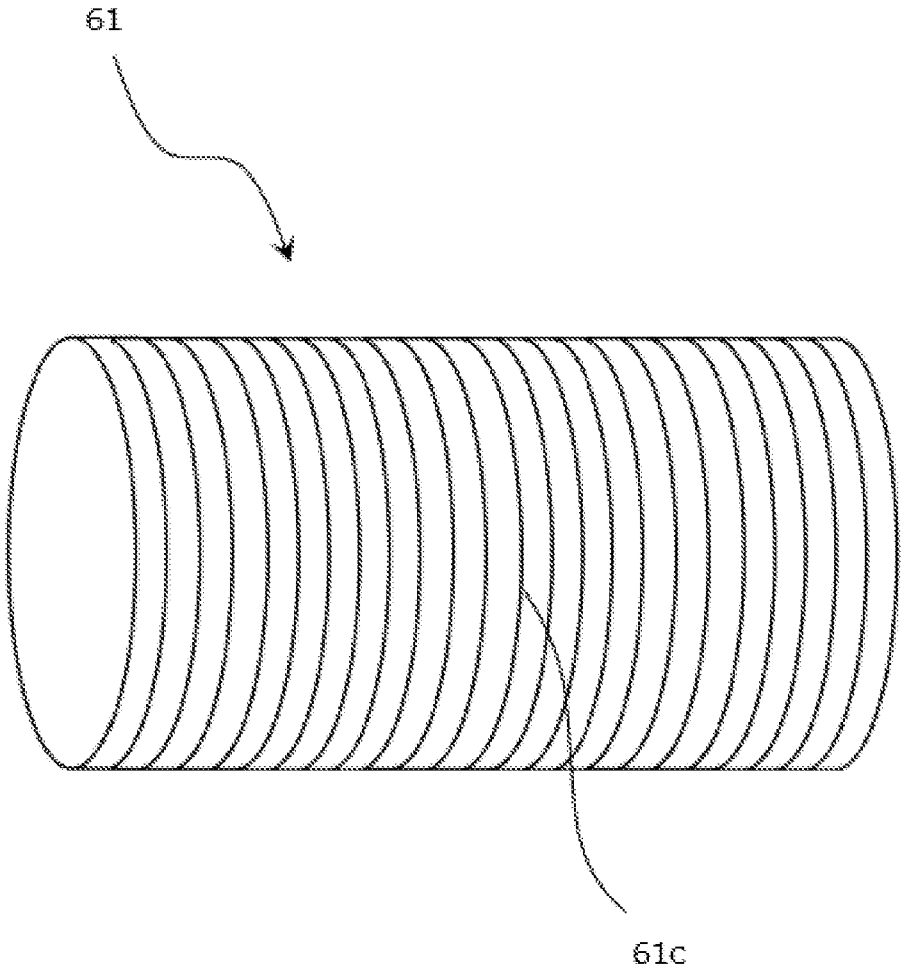
FIG. 3 is a perspective view showing the transport roll used in the electrospinning apparatus according to the embodiment.

Next, a modification of the transport roll 61 according to the above-mentioned embodiment will be described with reference to FIG. 3 to FIG. 5. The transport roll 61 includes grooves 61*c* as shown in FIG. 3, for example.

The grooves 61*c* are a plurality of grooves formed uniformly on the surface of the transport roll 61 in, for examples, a direction parallel to the rotation direction of the transport roll 61. Each of the grooves 61*c* has a predetermined width W (see FIG. 4 or FIG. 5). For example, in the case where the diameter of the transport roll 61 is φ1, the width W satisfies the relationship of "$W \leq 0.5 \times \varphi 1$". Further, a pitch P (see FIG. 4 or FIG. 5) between the grooves 61*c* is 1.1 times or more of the width W.

The groove 61*c* is formed on the surface of the transport roll 61 in order to reduce the contact area between a fiber film and the transport roll 61. Therefore, the direction in which the groove 61*c* is formed is not limited to the direction parallel to the rotation direction of the transport roll 61. For example, the groove 61*c* may be formed in a direction parallel to the rotation axis direction. Further, for example, the groove 61*c* may be formed so that a plurality of grooves intersects. Note that in the case where the groove 61*c* is formed in the direction parallel to the rotation direction of the transport roll 61, there are advantages that not only the contact area between the fiber film and the transport roll 61 can be reduced but also the air between the substrate 40 and the transport roll 61 can be exhausted to suppress slipping of the substrate 40 on the transport roll 61. Further, in the case where the groove 61*c* is formed in the direction parallel to the rotation axis direction of the transport roll 61, there is an advantage that the followability of rotation of the transport roll 61 with respect to movement of the substrate 40 is improved to suppress rubbing between the substrate 40 and the transport roll 61. Further, in the case where the plurality of grooves 61*c* is formed to intersect, one or both of the above-mentioned advantages can be achieved.

Figure 4:
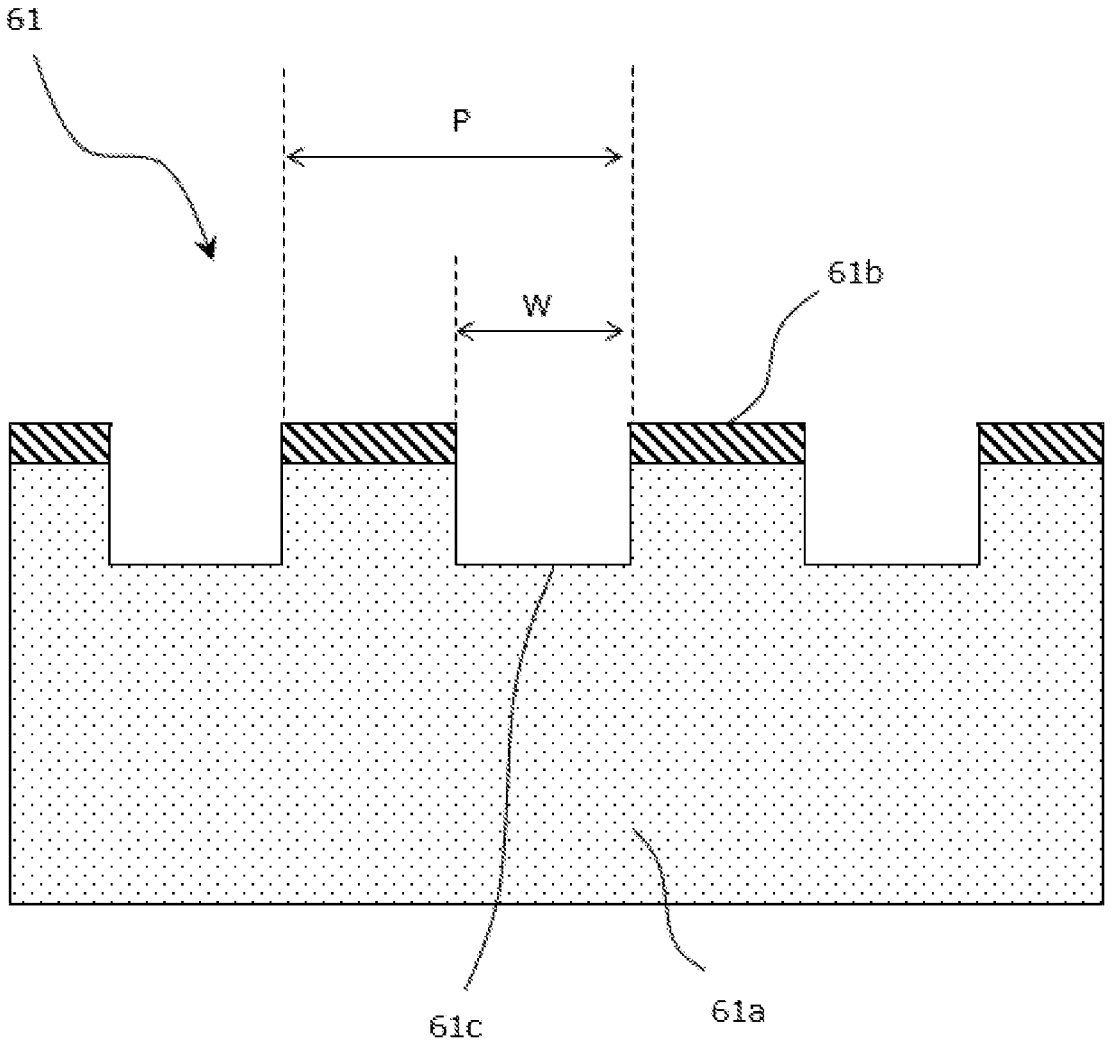
FIG. 4 is a cross-sectional view showing an example of a groove of the transport roll used in the electrospinning apparatus according to the embodiment.
Figure 5:
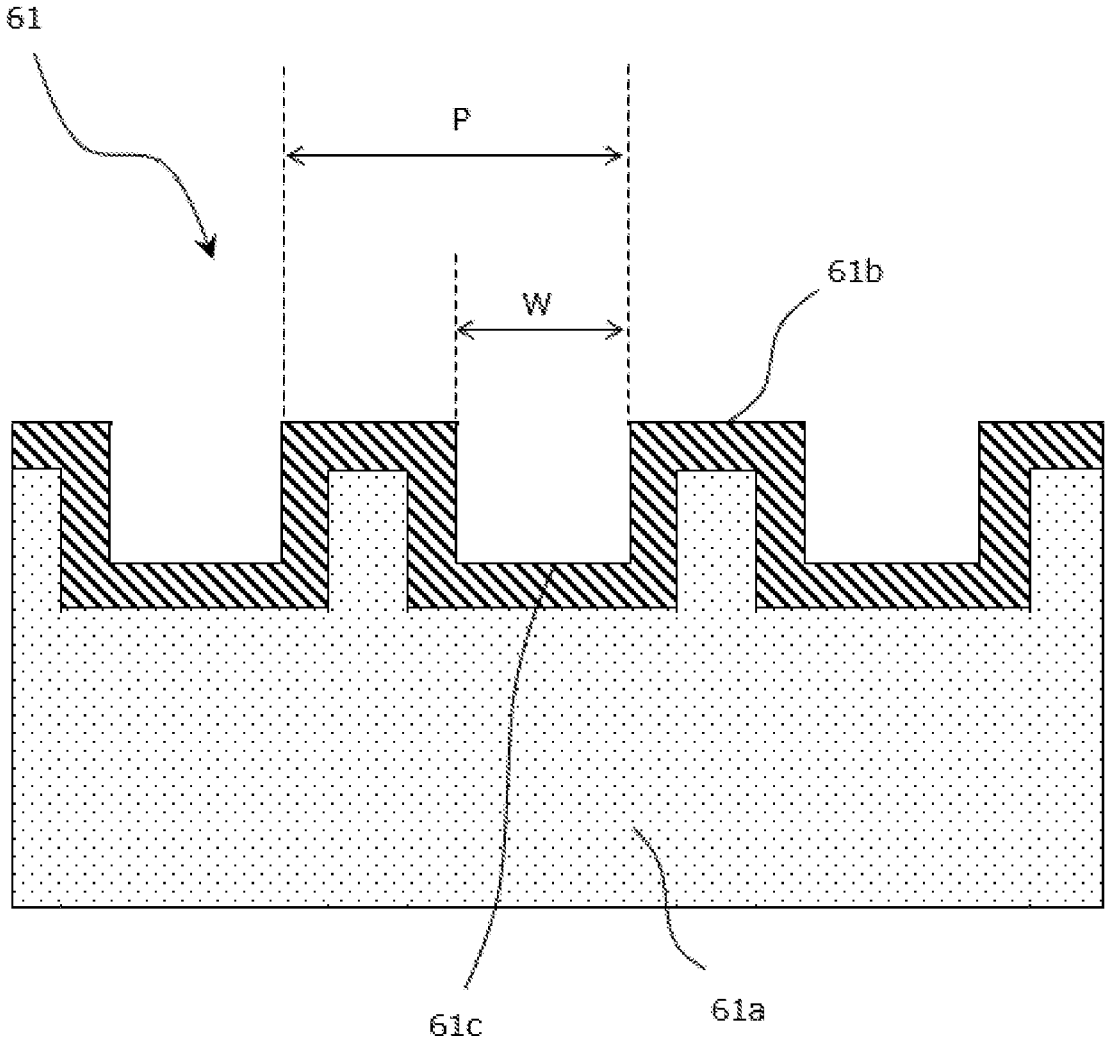
FIG. 5 is a cross-sectional view another example of the groove of the transport roll used in the electrospinning apparatus according to the embodiment.

Further, even when the transport roll 61 has a structure including the coating film 61*b*, the groove 61*c* does not necessarily need to be covered with the coating film 61*b* as shown in FIG. 4, or may be covered with the coating film 61*b* as shown in FIG. 5.

In the transport roll 61 shown in FIG. 4, the grooves 61*c* are formed after the coating film 61*b* is formed on the base 61*a*. In the transport roll 61 shown in FIG. 5, the coating film 61*b* is formed after the grooves 61*c* are formed on the base 61*a*.

By forming the grooves 61*c* on the surface of the transport roll 61, the contact area between a fiber film and the transport roll 61 is reduced. Therefore, the apparatus 10 suppresses the peeling off of the fiber film from the substrate 40, by the transport roll 61 including the grooves 61*c* transporting the substrate 40.

As described above, according to the embodiment, since the releasability of a transport roll from a fiber film can be improved, it is possible to provide an electrospinning apparatus capable of preventing the fiber film from being peeled off a substrate due to adhesion of the fiber film to the transport roll even in the case where the fiber film is formed on both surfaces of the substrate.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An electrospinning apparatus, comprising:

a plurality of transport rolls capable of transporting a substrate, the transport rolls having a transport surface that is in contact with the substrate when transporting the substrate, the transport surface of the transport rolls having a surface roughness Ra of 1.6 or less;

a first head unit, provided in a predetermined region between the transport rolls, capable of ejecting a raw material liquid of fiber toward a first surface of the substrate transported by the transport rolls to form a film of the fiber on the first surface of the substrate; and a second head unit, provided facing the first head unit via the substrate in the predetermined region, capable of ejecting the raw material liquid of fiber toward a second surface of the substrate transported by the transport rolls to form a film of the fiber on the second surface of the substrate, wherein the first head unit includes a first head and a second head, the first head and the second head are arranged on back sides of each other, and the second head ejects the raw material liquid of the fiber onto the first surface of the substrate onto which the first head ejects the raw material liquid of the fiber, wherein the second head unit includes a third head and a fourth head, the third head and the fourth head are arranged on back sides of each other, the fourth head ejects the raw material liquid onto the fiber on the second surface of the substrate onto which the third head ejects the raw material liquid of the fiber, wherein the third head is arranged to face the second head of the first head unit through the substrate.

2. The electrospinning apparatus according to claim 1, wherein the transport surface of the transport rolls includes a coating film, the coating film containing a fluorine resin.

3. The electrospinning apparatus according to claim 2, wherein the coating film contains at least one resin selected from polytetrafluoroethylene, a tetrafluoroethylene/perfluoroalkyl vinyl ether copolymer, a tetrafluoroethylene/hexafluoropropylene copolymer, and a tetrafluoroethylene/ethylene copolymer.

4. The electrospinning apparatus according to claim 1, wherein the transport rolls include grooves formed uniformly on the transport surface, and a relationship of $W \leq 0.5 \times \varphi 1$ is satisfied where a diameter of the transport roll is $\varphi 1$ and a width of each of the grooves is W.

5. The electrospinning apparatus according to claim 4, wherein a pitch between the grooves is 1.1 times or more of the width of each of the grooves.

6. The electrospinning apparatus according to claim 1, wherein the transport rolls include a base and a coating film, the base being formed of metal, the coating film being formed on a surface of the base and having a thickness of 10 mm or less.

7. An electrospinning apparatus, comprising:

a plurality of transport rolls capable of transporting a substrate, the transport rolls having a transport surface that is in contact with the substrate when transporting the substrate, the transport surface of the transport rolls including a coating film, the coating film containing a fluorine resin;

a first head unit, provided in a predetermined region between the transport rolls, capable of ejecting a raw material liquid of fiber toward a first surface of the substrate transported by the transport rolls to form a film of the fiber on the substrate; and a second head unit, provided facing the first head unit via the substrate in the predetermined region, capable of ejecting the raw material liquid of fiber toward a second surface of the substrate transported by the transport rolls to form a film of the fiber on the second surface of the substrate, wherein the first head unit includes a first head and a second head, the first head and the second head are arranged on back sides of each other, and the second head ejects the raw material liquid of the fiber onto the first surface of the substrate onto which the first head ejects the raw material liquid of the fiber, wherein the second head unit includes a third head and a fourth head, the third head and the fourth head are arranged on back sides of each other, the fourth head ejects the raw material liquid onto the fiber on the second surface of the substrate onto which the third head ejects the raw material liquid of the fiber, wherein the third head is arranged to face the second head of the first head unit through the substrate.

8. The electrospinning apparatus according to claim 7, wherein the coating film contains at least one resin selected from polytetrafluoroethylene, a tetrafluoroethylene/perfluoroalkyl vinyl ether copolymer, a tetrafluoroethylene/hexafluoropropylene copolymer, and a tetrafluoroethylene/ethylene copolymer.

9. The electrospinning apparatus according to claim 7, wherein the transport rolls include grooves formed uniformly on a surface of the coating film, and a relationship of $W \leq 0.5 \times \varphi 1$ is satisfied when a diameter of the transport rolls is $\varphi 1$ and a width of each of the grooves is W.

10. The electrospinning apparatus according to claim 9, wherein a pitch between the grooves is 1.1 times or more of the width of each of the grooves.

11. The electrospinning apparatus according to claim 7, wherein the coating film has a surface roughness Ra of 1.6 or less.

12. The electrospinning apparatus according to claim 7, wherein the transport rolls include a base formed of metal, the coating film being formed on a surface of the base and having a thickness of 10 mm or less.

* * * * *